US012492698B2

(12) United States Patent
Hong

(10) Patent No.: US 12,492,698 B2
(45) Date of Patent: Dec. 9, 2025

(54) PUMP

(71) Applicant: LG INNOTEK CO., LTD., Seoul (KR)

(72) Inventor: Hoon Ki Hong, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 42 days.

(21) Appl. No.: 18/570,933

(22) PCT Filed: Jun. 9, 2022

(86) PCT No.: PCT/KR2022/008101
§ 371 (c)(1),
(2) Date: Dec. 15, 2023

(87) PCT Pub. No.: WO2023/282476
PCT Pub. Date: Jan. 12, 2023

(65) Prior Publication Data

US 2024/0280103 A1 Aug. 22, 2024

(30) Foreign Application Priority Data

Jul. 5, 2021 (KR) ..... 10-2021-0087908

(51) Int. Cl.
*F04C 2/10* (2006.01)
*F04C 15/00* (2006.01)

(52) U.S. Cl.
CPC ..... *F04C 2/102* (2013.01); *F04C 15/0065* (2013.01); *F04C 2240/20* (2013.01); *F04C 2240/30* (2013.01); *F04C 2240/40* (2013.01); *F04C 2240/50* (2013.01)

(58) Field of Classification Search
CPC .. F04C 2/102; F04C 15/0065; F04C 2240/20; F04C 2240/30; F04C 2240/40; F04C 2240/50; F04C 29/0085
See application file for complete search history.

(56) References Cited

U.S. PATENT DOCUMENTS

| | | | | |
|---|---|---|---|---|
| 2005/0220653 | A1 | 10/2005 | Shafer et al. | |
| 2012/0164009 | A1* | 6/2012 | Sakata | F04C 2/084 418/171 |
| 2018/0163723 | A1 | 6/2018 | Horimatsu et al. | |
| 2019/0249661 | A1* | 8/2019 | Wang | F04C 11/008 |
| 2020/0248693 | A1 | 8/2020 | Wahl | |

FOREIGN PATENT DOCUMENTS

| | | |
|---|---|---|
| JP | 2000-352382 | 12/2000 |
| JP | 2005-207245 | 8/2005 |
| JP | 2011-058441 | 3/2011 |
| KR | 10-2017-0032659 | 3/2017 |
| KR | 10-2020-0120897 | 10/2020 |

OTHER PUBLICATIONS

International Search Report dated Sep. 19, 2022 issued in Application No. PCT/KR2022/008101.
European Search Report dated Apr. 14, 2025 issued in Application No. 22837830.3.

* cited by examiner

*Primary Examiner* — David N Brandt
(74) *Attorney, Agent, or Firm* — KED & ASSOCIATES

(57) ABSTRACT

A pump comprises: an external gear, a magnet coupled to the external gear; an internal gear disposed inside the external gear; a support having a portion disposed between the external gear and the magnet; and a bearing coupled to the support, wherein the support includes a protruding part coupled to the inner surface of the bearing.

20 Claims, 9 Drawing Sheets

| | Achieved hydraulic pressure | No-load current |
|---|---|---|
| Sample "A" | 4 | 3.5 |
| Sample "B" | 8 | 1.75 |

PUMP

CROSS-REFERENCE TO RELATED PATENT APPLICATIONS

This application is a U.S. National Stage Application under 35 U.S.C. § 371 of PCT Application No. PCT/KR2022/008101, filed Jun. 9, 2022, which claims priority to Korean Patent Application No. 10-2021-0087908, filed Jul. 5, 2021, whose entire disclosures are hereby incorporated by reference.

TECHNICAL FIELD

The present embodiment relates to a pump.

BACKGROUND ART

The pump includes a motor area that generates rotational driving force and a pump area that generates hydraulic pressure. Therefore, since the motor area and the pump area inside the pump are separated from each other, there is a problem in that the number of parts and the overall product are increased.

In addition, since the EOP according to the prior art does not have a means to support the axial load applied to the external rotor, as the operating pressure in the pump increases, there is a problem that the rotational stability of the outer or inner rotor is degraded due to the force being applied at the outlet of the pump. In particular, when high pressure of 3 bar or more is generated, friction with the housing occurs due to the misalignment of the axial system of the external rotor, which is a factor that impairs the performance of the pump.

DETAILED DESCRIPTION OF THE INVENTION

Technical Subject

The present embodiment is intended to provide a pump that can firmly fix the external gear inside the housing by improving the structure and improve driving efficiency.

In addition, it is intended to provide a pump that can be miniaturized by reducing its size.

Technical Solution

The pump according to the present embodiment comprises: an external gear; a magnet being coupled to the external gear; an internal gear disposed inside the external gear; a support being partially disposed between the external gear and the magnet; and a bearing being coupled to the support, wherein the support includes a protruding part being coupled to an inner surface of the bearing.

The external gear may include a core, and the support may be disposed between the core and the magnet.

The core includes a first region on an outer surface where a guide being in contact with a side surface of the magnet is disposed, and a second region on which the support is disposed on an outer surface, and the cross-sectional area of the first region may be larger than the cross-sectional area of the second region.

The axial length of the magnet may be smaller than the axial length of the guide.

It may include a stator being disposed outside the external gear, and include a can being disposed inside the stator and containing a space wherein the internal gear and the external gear are disposed.

The can includes a second protruding part being protruded upward from an upper surface, and the protruding part and the bearing may be disposed in a bearing space inside the second protruding part.

The cross-sectional area of the bearing may correspond to the cross-sectional area of the bearing space.

The support can rotate integrally with the external gear.

The external gear and the internal gear may be rotated eccentrically.

A pump according to another embodiment comprises: an external gear; a magnet being coupled to the external gear; an internal gear disposed inside the external gear; and a support being coupled to the external gear, wherein the support includes: a base being disposed on one side surface of the internal gear; a coupling portion being coupled to the side surface of the external gear; and a protruding part being protruded in a direction opposite to the coupling portion.

Advantageous Effects

Through the present embodiment, the internal gear is coupled with the protruding part of the first cover to align the center of axis, and since the center of axis of the external gear can be aligned through the support and bearing, it has the advantage of preventing the axial system of the external gear or internal gear from being misaligned due to pressure differences between different regions inside the housing.

BEST MODE

Hereinafter, preferred embodiments of the present invention will be described in detail with reference to the accompanying drawings.

However, the technical idea of the present invention is not limited to some embodiments to be described, but may be implemented in various forms, and inside the scope of the technical idea of the present invention, one or more of the constituent elements may be selectively combined or substituted between embodiments.

In addition, the terms (including technical and scientific terms) used in the embodiments of the present invention, unless explicitly defined and described, can be interpreted as a meaning that can be generally understood by a person skilled in the art, and commonly used terms such as terms defined in the dictionary may be interpreted in consideration of the meaning of the context of the related technology.

In addition, terms used in the present specification are for describing embodiments and are not intended to limit the present invention.

In the present specification, the singular form may include the plural form unless specifically stated in the phrase, and when described as "at least one (or more than one) of A and B and C", it may include one or more of all combinations that can be combined with A, B, and C.

In addition, in describing the components of the embodiment of the present invention, terms such as first, second, A, B, (a), and (b) may be used.

These terms are merely intended to distinguish the components from other components, and the terms do not limit the nature, order or sequence of the components.

And, when a component is described as being 'connected', 'coupled' or 'interconnected' to another component, the component is not only directly connected, coupled or interconnected to the other component, but may also include cases of being 'connected', 'coupled', or 'interconnected' due that another component between that other components.

In addition, when described as being formed or arranged in "on (above)" or "below (under)" of each component, "on (above)" or "below (under)" means that it includes not only the case where the two components are directly in contact with, but also the case where one or more other components are formed or arranged between the two components. In addition, when expressed as "on (above)" or "below (under) ", the meaning of not only an upward direction but also a downward direction based on one component may be included.

Figure 4:
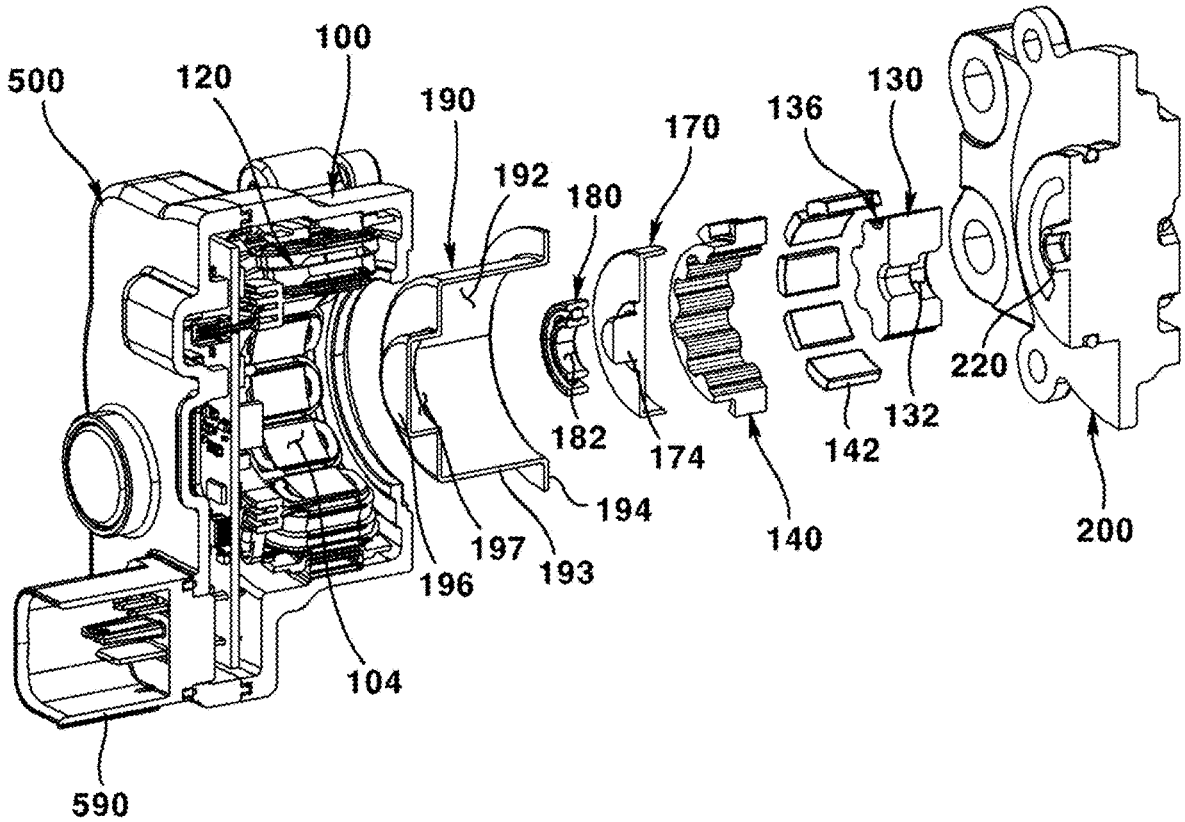
FIG. 4 is an exploded perspective view of the main components in a pump according to an embodiment of the present invention.
Figure 5:
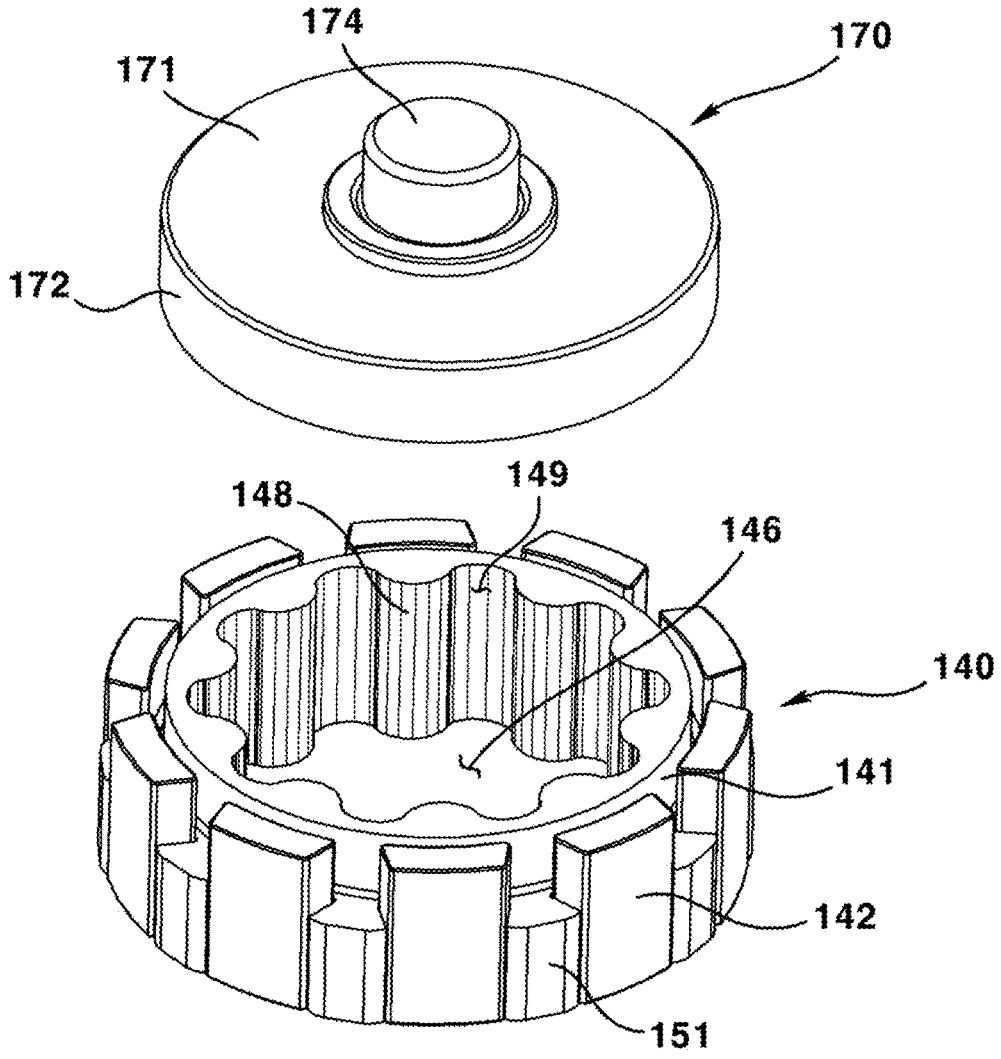
FIG. 5 is an exploded perspective view of a support and external gear according to an embodiment of the present invention.

The 'axial direction' used below is defined as the direction that forms the center of rotation of an internal gear or external gear. The 'axial direction' may be the direction in which components disassembled based on FIG. 4 or FIG. 5 are coupled.

The 'radial direction' used below is defined as the direction perpendicular to the 'axial direction' described above. The 'radial direction' may be defined as the protruding direction of the first lobe from an inner surface of the external gear and the protruding direction of the second lobe from an inner surface of the internal gear.

The 'circumferential direction' used below is a circumferential direction of any one among a stator, an external gear, and an internal gear, or it may be defined as the circumferential direction of a region that forms a virtual concentric circle with the circumferential direction of any one among the stator, external gear, and internal gear.

Figure 1:
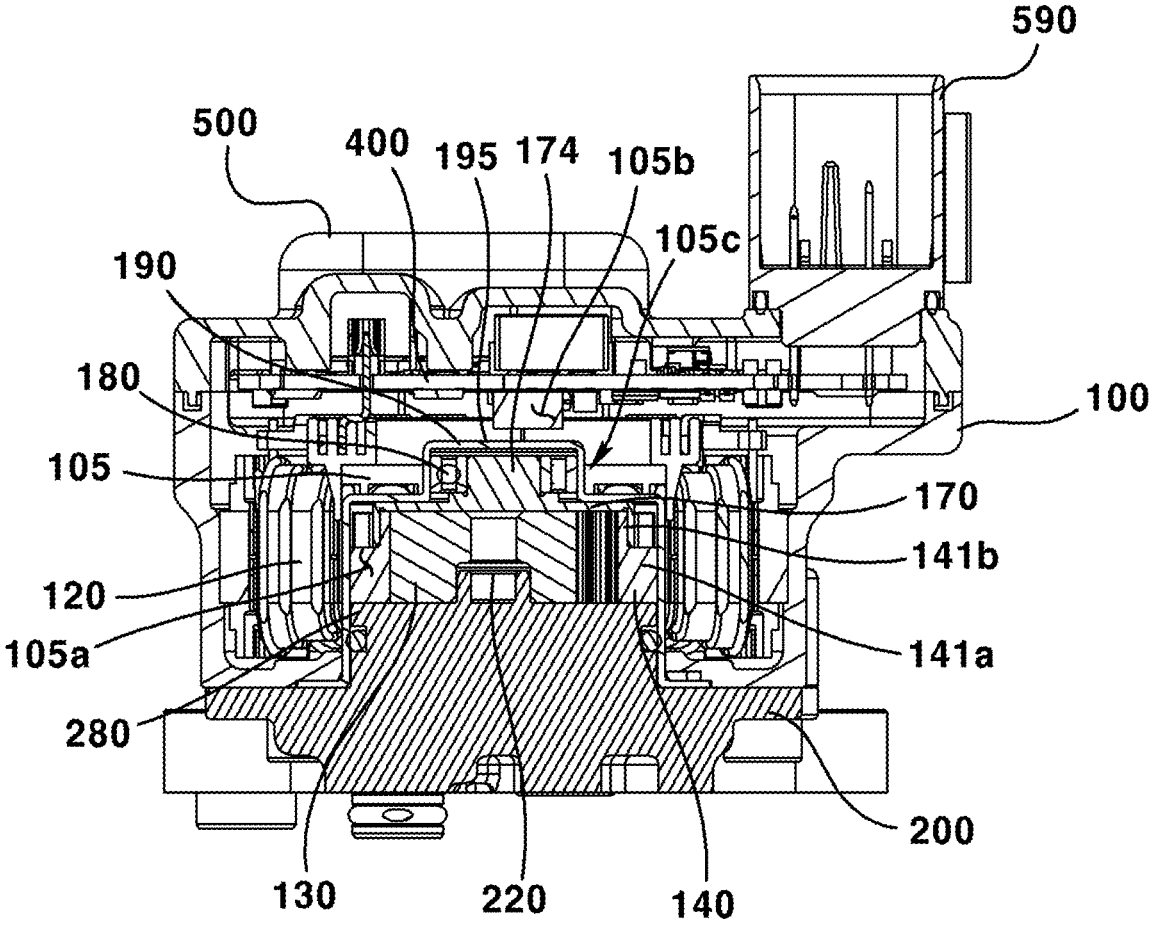
FIG. 1 is a cross-sectional view of a pump according to an embodiment of the present invention.
Figure 2:
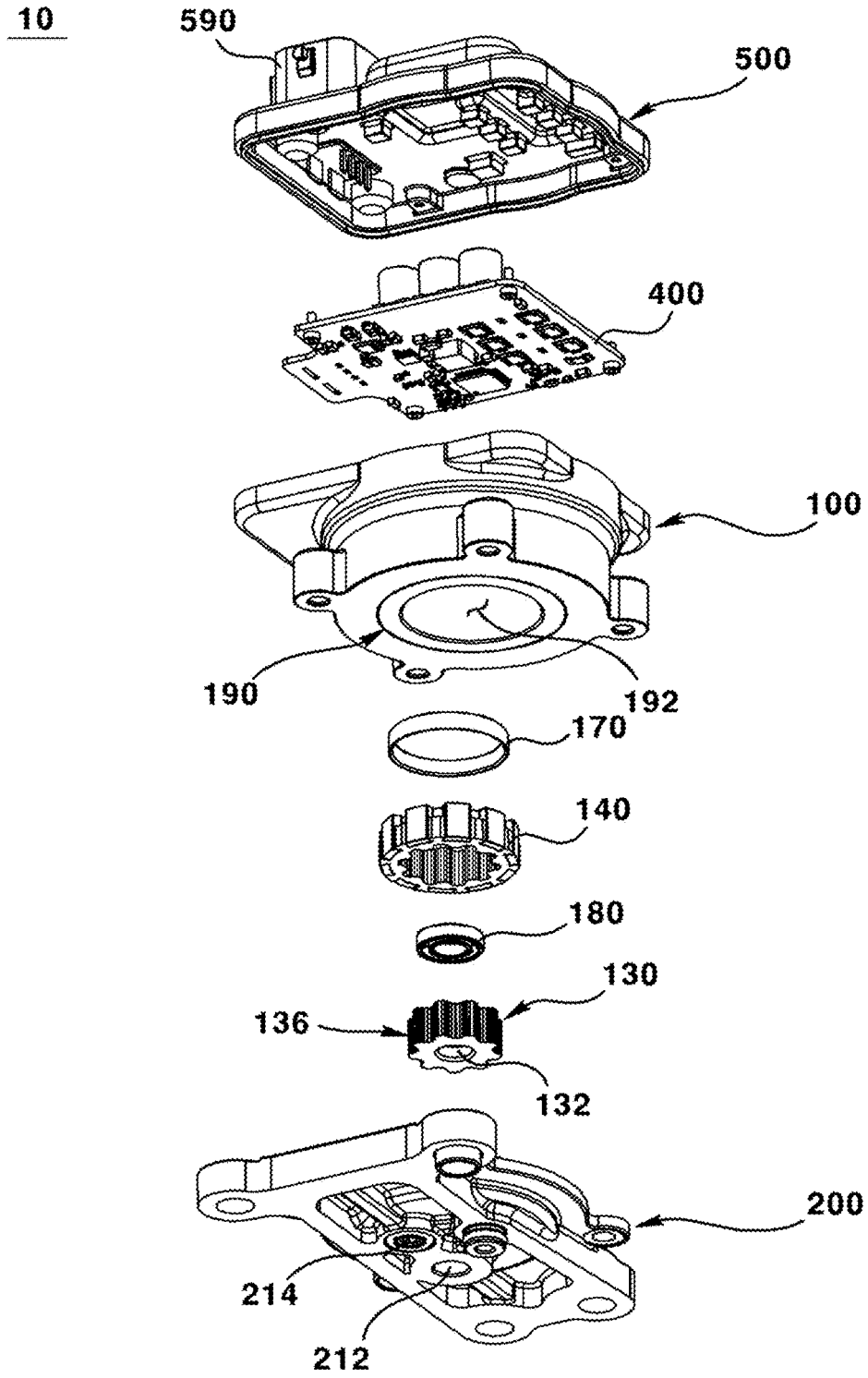
FIG. 2 is an exploded perspective view of a pump according to an embodiment of the present invention.
Figure 3:
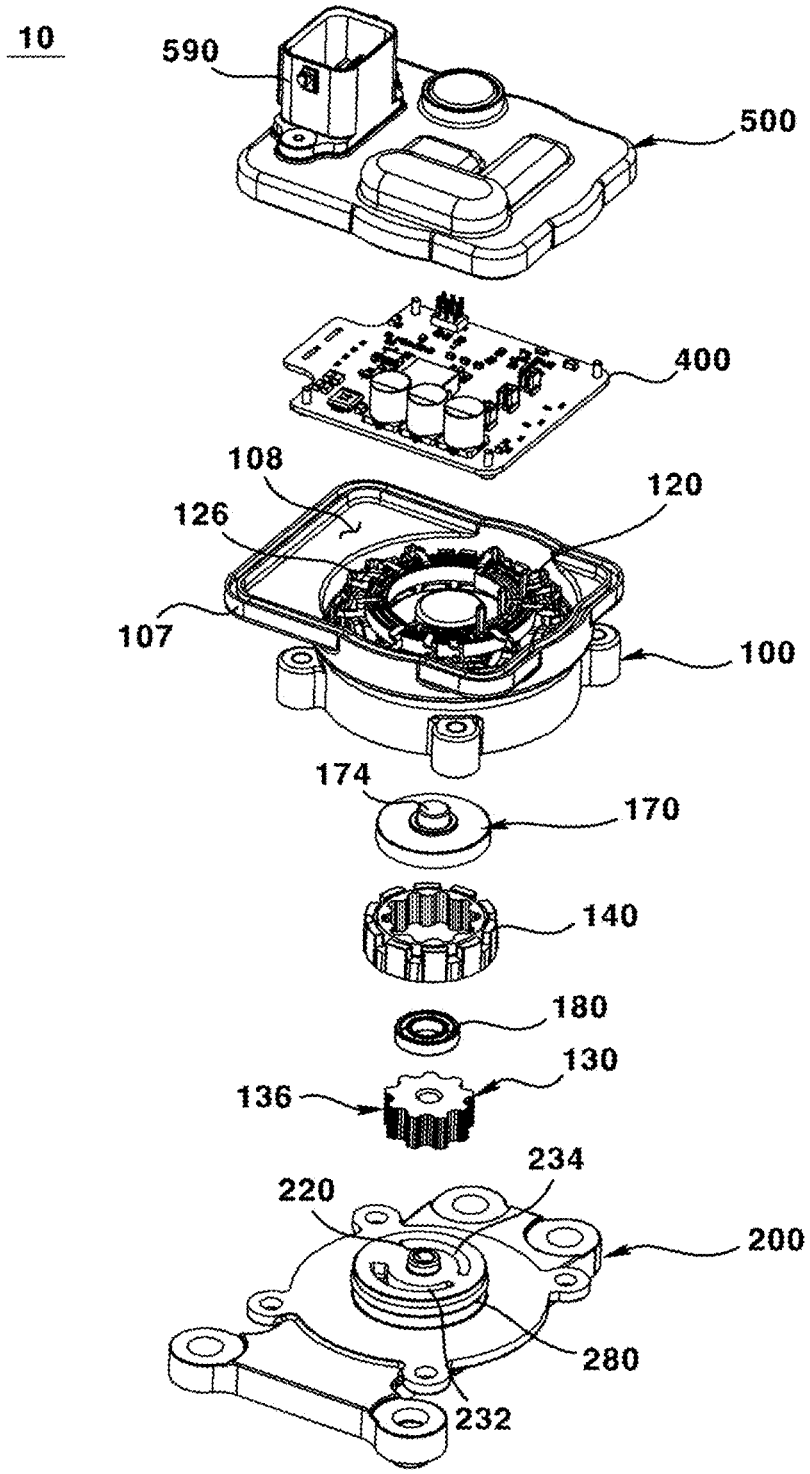
FIG. 3 is a view illustrating FIG. 2 from another angle.
Figure 6:
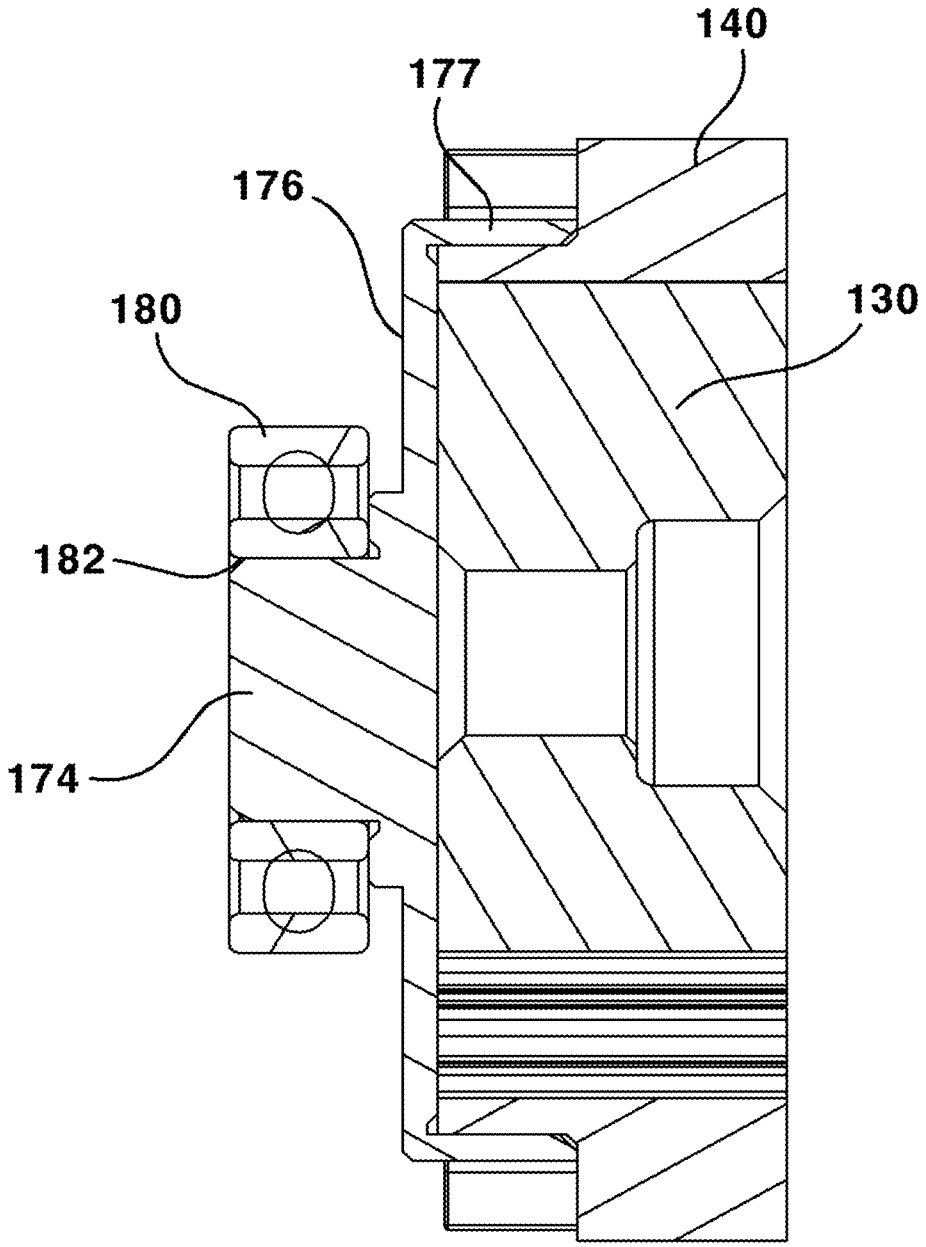
FIG. 6 is a cross-sectional view illustrating the combined structure of a bearing and a support according to an embodiment of the present invention.
Figure 7:
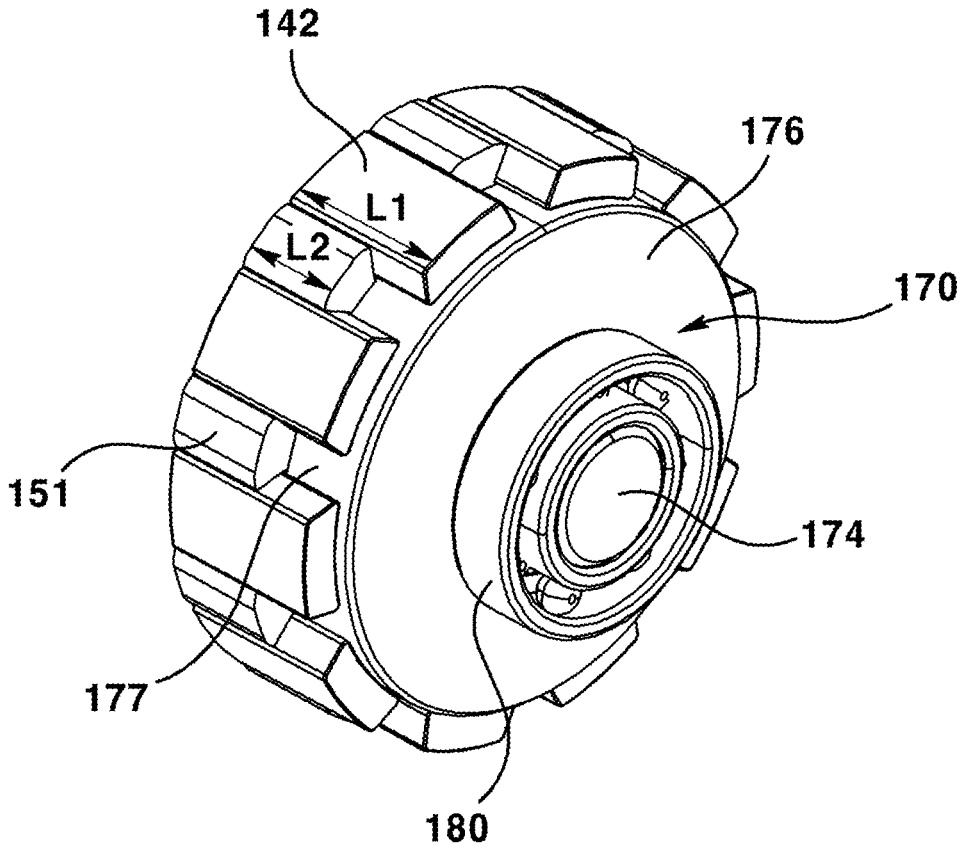
FIG. 7 is a perspective view illustrating a coupled structure of an external gear, support, and bearing according to an embodiment of the present invention.
Figure 8:
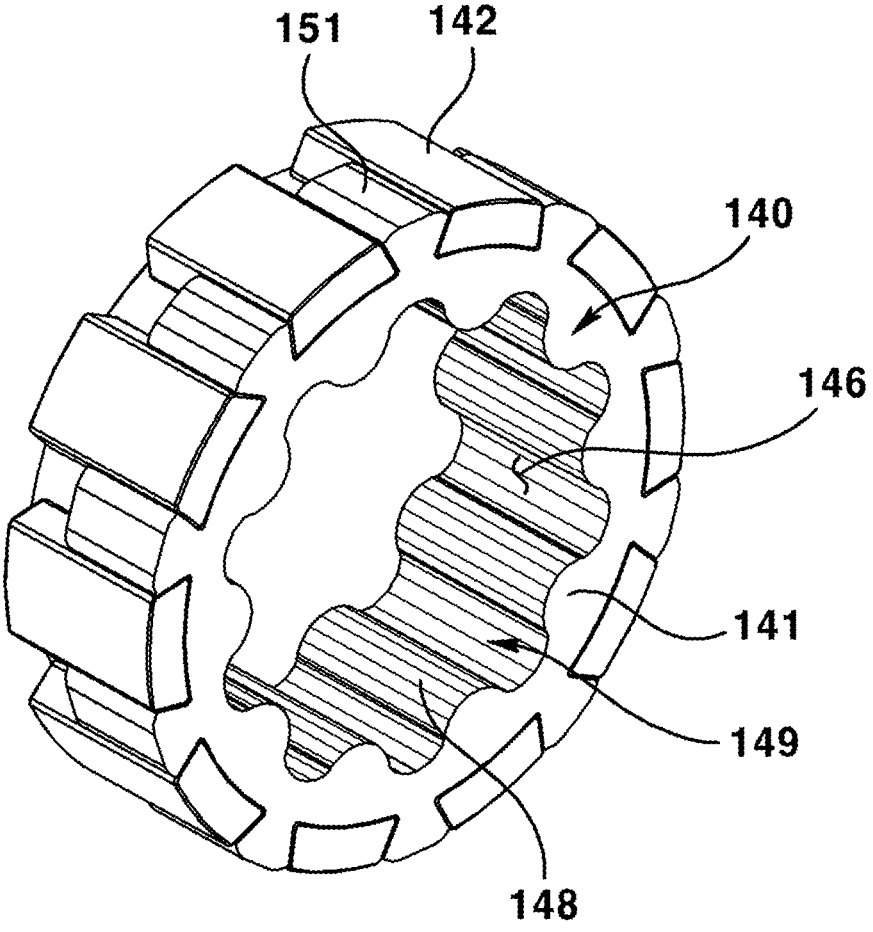
FIG. 8 is a perspective view illustrating FIG. 7 from another angle.
Figure 9:
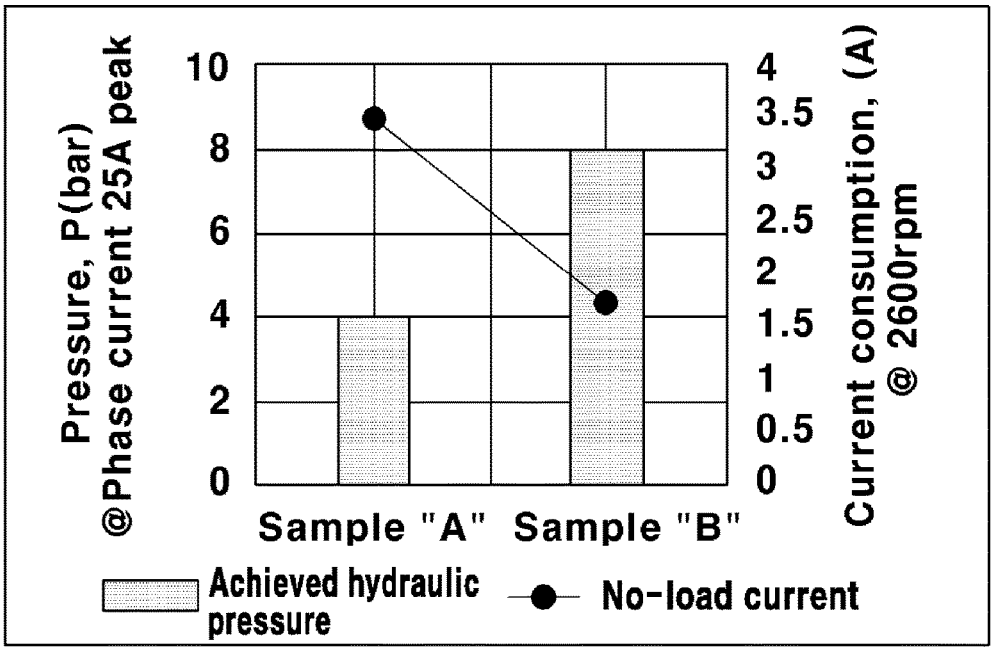
FIG. 9 is a graph comparing the outlet pressure of a pump according to the prior art and a pump according to an embodiment of the present invention.

FIG. 1 is a cross-sectional view of a pump according to an embodiment of the present invention; FIG. 2 is an exploded perspective view of a pump according to an embodiment of the present invention; FIG. 3 is a view illustrating FIG. 2 from another angle; FIG. 4 is an exploded perspective view of the main components in a pump according to an embodiment of the present invention; FIG. 5 is an exploded perspective view of a support and external gear according to an embodiment of the present invention; FIG. 6 is a cross-sectional view illustrating the combined structure of a bearing and a support according to an embodiment of the present invention; FIG. 7 is a perspective view illustrating a coupled structure of an external gear, support, and bearing according to an embodiment of the present invention; FIG. 8 is a perspective view illustrating FIG. 7 from another angle; and FIG. 9 is a graph comparing the outlet pressure of a pump according to the prior art and a pump according to an embodiment of the present invention.

Referring to FIGS. 1 to 9, the outer appearance of a pump 10 according to an embodiment of the present invention may be formed by the coupling of a housing 100, a first cover 200, and a second cover 500.

With respect to the housing 100, the first cover 200 may be coupled to a lower surface of the housing 100. The second cover 500 may be coupled to an upper surface of the housing 100. The housing 100 and the first cover 200 may be coupled to each other through screws. The housing 100 and the second cover 500 may be coupled to each other through screws.

On one side of the first cover 200, a first opening 212 through which fluid is sucked and a second opening 214 through which the circulated fluid is discharged may be formed. On the other side of the cover 200, a third opening 232 connected to the first opening 212 and a fourth opening 234 connected to the second opening 214 may be formed. That is, the first opening 212 and the second opening 214 are formed on a lower surface of the first cover 200, and the third opening 232 and the fourth opening 234 may be formed on an upper surface of the first cover 200 being coupled to the housing 100.

A mounting portion 280 may be disposed on an upper surface of the first cover 200 being protruded upward and coupled to the space 192 inside the can 190, which will be described later. The cross section of the mounting portion 280 may be circular. A screw thread or screw groove may be formed on an outer circumferential surface of the mounting portion 280. In addition, a screw groove or screw groove may be formed on an inner circumferential surface inside the space 192 facing an outer circumferential surface of the mounting portion 280. Because of this, the mounting portion 280 can be screw-coupled to an inner surface of the space 192. The cross-sectional shape of the mounting portion 280 may correspond to the cross-sectional shape of the space 192. A ring-shaped sealing member may be disposed between an outer circumferential surface of the mounting portion 280 and an inner surface of the space 192 for sealing. The sealing member is made of a rubber material and can prevent fluid from leaking between an outer circumferential surface of the mounting portion 280 and an inner surface of the space 192.

A third opening 232 through which fluid is sucked and a fourth opening 234 through which the sucked fluid is discharged may be formed on an upper surface of the first cover 200. The fluid may be oil. Each of the third opening 232 and the fourth opening 234 may be formed to have an arc shape, and it may be provided in a way that the gap therebetween become gradually narrower as it travels from one side to the other. More specifically, it can be disposed in a way that the side with a wider gap of the third openings 232 is directed toward the side with a wider gap of the fourth openings 234, and the side with a narrower gap of the third opening 232 is directed toward the side with a narrower gap of the fourth opening 234.

The third opening 232 and the fourth opening 234 may be formed on an upper surface of the mounting portion 280.

A protruding part 220 being protruded upward may be disposed on an upper surface of the first cover 200. The protruding part 220 may be disposed in the center of the mounting portion 280. The protruding part 220 is coupled to the hole 132 of the internal gear 130, which will be described later, and can support the rotation of the internal gear 130.

A second space 108 may be formed on an upper surface of the housing 100. The second space 108 may have a groove shape. A plurality of electronic components for driving may be disposed in the second space 108. For example, a printed circuit board 400 and a terminal (not shown) may be placed in the second space 108. Multiple devices may be mounted on the circuit board 400.

A region 107 of the housing 100 inside which the second space 108 is disposed may have a larger cross-sectional area than other regions.

The second cover 500 may be coupled to an upper portion of the housing 100 to cover the second space 108. A plurality of protruding regions being protruded upward may be formed on an upper surface of the second cover 500. The cross-sectional area of the second cover 500 may be increased through the protruding region. Accordingly, heat generated in the second space 108 can be dissipated. In addition, at least a portion of electronic components being disposed on the printed circuit board 400 may be accommodated inside the protruding region.

The second cover 500 may include a connector mounting portion 590 inside which a connector (not shown) is disposed. One end of the connector is coupled to an upper surface of the printed circuit board 400, and the other end may be exposed to the outside through the connector mounting portion 590. An external terminal may be coupled to the connector mounting portion 590. Due to this, power can be applied to the pump 10, or a signal for driving can be transmitted or received.

A stator 120 and a pump gear may be disposed in the housing 100. The pump gear may include an external gear 140 and an internal gear 130. The internal gear 130 may be disposed inside the external gear 140. The housing 100 may be made of resin or plastic, but is not limited thereto.

The housing 100 may include a first partition wall 105 that partitions a first region 105*a* and a second region 105*b*. The first region 105*a* may include a first space 104. The second region 105*b* may include a second space 108. The first space 104 and the second space 180 may not be connected by the first partition wall 105, but as illustrated in FIG. 1, a hole 105*c* where the protruding part 190 of a can 190, which will be described later, is coupled may be formed in the first partition wall 105.

The stator 120 may be disposed inside the housing 100.

The stator 120 may be formed integrally with the housing 100 by double injection. The stator 120 and the housing 100 may be formed integrally by insert injection. The stator 120 may be molded inside the housing 100. A stator accommodation space in which the stator 120 is disposed may be formed inside the housing 100. The stator accommodation space may be disposed outside the first space 104. The outer surface of the stator 120 may be surrounded by the housing 100.

The stator 120 may include a core and a coil 126 being wound around the core. The stator 120 may include an insulator (not shown) being disposed to surround an outer surface of the core. The coil 126 may be wound on an outer surface of the insulator.

The first space 104 may be disposed in the central region of the housing 100. The first space 104 may have a groove shape in which a portion of a lower surface of the housing 100 is recessed upward. The disposed region of the stator 120 and the first space 104 may be partitioned by a second partition wall (not shown). In other words, the second partition wall may be disposed between the stator 120 and an external gear 140, which will be described later. The second partition wall may be formed to have a thickness of 0.2 mm to 1 mm.

The second space 108 and the first space 104 may be partitioned in upper and lower directions by a first partition wall 105. A lower surface of the first partition wall 105 may form an upper surface of the first space 104. The first space 104 and the second space 108 can be partitioned into different regions through the first partition wall 105. Accordingly, it is possible to prevent fluid inside the first space 104 from flowing into the second space 108.

The external gear 140 and the internal gear 130 may be disposed in the second space 105*a*.

The external gear 140 may be disposed inside the stator 120. The second partition wall may be disposed between the external gear 140 and the stator 120.

The external gear 140 may include a core 141 and a magnet 142 being mounted in the core 141. The magnet 142 may be disposed on an outer circumferential surface of the core 141 to correspond to the coil 126. The external gear 140 may be of a surface permanent magnet (SPM) type in which the magnet 142 is attached to an outer circumferential surface of the core 141. To this end, a groove in which the magnet 144 is mounted may be formed on an outer circumferential surface of the core 141. The grooves may be provided in plural and disposed to be spaced apart from each other along a circumferential direction.

A guide 151 being protruded outward from an outer surface of the core 141 may be disposed between adjacent magnets 142 to support the side surfaces of the magnets 142. An axial length L2 of the guide 151 may be smaller than an axial length L1 of the magnet 142. Accordingly, the groove in which the magnet 144 is mounted can be understood as being disposed between adjacent guides 151. The side surface of the guide 151 facing the side surface of the magnet 142 may have an inclined surface whose length in a circumferential direction increases as it travels outward. And, an inclined surface corresponding to the inclined surface may be formed on a side surface of the magnet 142 facing the side surface of the guide 151.

Therefore, when a current is applied to the coil 126 of the stator 120, the external gear 140 may be rotated by electromagnetic interaction between the stator 120 and the external gear 140.

A first hole 146 in which the internal gear 130 is disposed may be formed in the center of the external gear 140. Pluralities of peaks 148 being protruded inward from an inner circumferential surface and valleys being disposed between the pluralities of peaks 148 may be formed on an inner circumferential surface of the first hole 146. That is, a first gear in which pluralities of peaks 148 and valleys are alternately disposed may be formed on an inner circumferential surface of the first hole 146.

The internal gear 130 may be disposed inside the external gear 140. The external gear 140 may be referred to as an external rotor, and the internal gear 130 may be referred to as an internal rotor. The internal gear 130 and the external gear 140 may be disposed so that their centers do not coincide with each other.

In an outer circumferential surface of the internal gear 130, pluralities of peaks being protruded outward from an outer periphery, and valleys being disposed between the pluralities of peaks may be included. A second gear may be formed on an outer circumferential surface of the internal gear 130 in which pluralities of peaks and pluralities of valleys are being alternately disposed.

In other words, in the internal gear 130, a second lobe 136 facing outward in a radial direction with respect to the center of rotation and has N gear teeth can be disposed along the direction. In the external gear 140, N+1 first lobes 149 may be provided facing inward in a radial direction. The first lobe 149 may be disposed to be caught by the second lobe 136. When the external gear 140 rotates, the internal gear 130 may rotate by the first lobe 149 and the second lobe 136. As the internal gear 130 rotates, fluid may flow into the space 192 inside the can 190, which will be described later, or fluid inside the space 192 may be discharged to the outside.

The centers of rotation of the external gear 140 and the internal gear 130 may be different.

In summary, the eccentricity of the external gear 140 and the internal gear 130 creates a volume capable of transporting fluid fuel between the external gear 140 and the internal gear 130, so that the portion of the increased volume sucks in surrounding fluids due to a pressure drop, and the portion of the decreased volume discharges fluids due to an increase in pressure.

The pump 10 may include a can 190. The can 190 may be disposed in the first space 104. The can 190 may be made of a metal material. The can 190 may be formed integrally with the housing 100 by double injection. However, this is an example, and the can 190 may be made of plastic material.

The can 190 may include: a body portion 193, a lower end portion 194 being protruded outward from a lower end of the body portion 193; and a second protruding part 196 being protruded upward from an upper surface of the body portion 193.

A space 192 may be formed inside the body portion 193. The internal gear 130 and the external gear 140 may be disposed in the space 192. The cross-sectional shape of the body portion 193 may be formed to correspond to the cross-sectional shape of the first space 104.

The lower end portion 194 may be formed to be bent and extended outward from the lower end of the body portion 193. The lower end portion 194 may be disposed between a lower surface of the housing 100 and an upper surface of the first cover 200.

The second protruding part 196 may be coupled to a hole 105*c* inside the first partition wall 105. The cross-sectional shape of the second protruding part 196 may be formed to correspond to the cross-sectional shape of the hole 105*c*. The upper end of the second protruding part 196 is protruded more upward than an upper surface of the first partition wall 105, and at least a portion may be disposed inside the second region 105*b*.

A bearing space 197 may be formed inside the second protruding part 196 to accommodate a bearing 180 and a first protruding part 174, which will be described later. The second protruding part 196 may be formed to have a smaller cross-sectional area than the body portion 193.

It is possible to prevent fluid inside the first region 105*a* from flowing into the second region 105*b* by the can 190.

The pump 10 may include a support 170. The support 170 is coupled to the external gear 140 and can support the external gear 140 inside the space 192. The support 170 has a circular cross-sectional shape and may be coupled to an upper portion of the external gear 140. The support 170 may be coupled to the external gear 140 by press fitting.

The support 170 may include a base 171 being disposed on one side surface of the internal gear 140. As an example, the base 171 may be coupled to an upper surface of the internal gear 140. The cross-sectional area of the base 171 may be formed to be smaller than the cross-sectional area of the external gear 140.

The support 170 may include a coupling portion 172 being protruded downward from an edge region of the base 171 and coupled to a side surface of the external gear 140. The coupling portion 172 may be disposed between an outer surface of the core 141 and an inner surface of the magnet 142. The inner surface of the coupling portion 172 may face an outer surface of the core 141, and an outer surface of the coupling portion 172 may face an inner surface of the magnet 142. The lower end of the coupling portion 172 may be in contact with an upper surface of the guide 151.

In detail, the support 170 may be disposed between the magnet 142 and the core 141. For this purpose, the core 141 has a first region 141*a* (see FIG. 1) on which the guide 151 is disposed on an outer circumferential surface, and the support 170 is disposed on an upper portion of the first region 141*a* and may include a second region 141*b* being coupled to an outer circumferential surface. The cross-sectional area of the first region 141*a* may be smaller than that of the second region 141*b*. The cross-sectional area of the space inside the support 170 may correspond to the cross-sectional area of the second region 141*b*.

When the support 170 is coupled to an outer circumferential surface of the second region 141*b*, the inner surface of the support 170 faces the outer surface of the second region 141*b*, and the outer surface of the support 170 may be disposed to face the inner surface of the magnet 142. An adhesive region may be formed between an inner surface of the support 170 and an outer surface of the second region 141, and between an outer surface of the support 170 and an inner surface of the magnet 142. A lower end of the support 170 may be in contact with an upper surface of the first region 141*a*.

The support 170 may include a first protruding part 174 being protruded upward from an upper surface. The first protruding part 174 may be protruded from the base 171 in a direction opposite to the protruding direction of the coupling portion 172. That is, the first protruding part 174 may be protruded upward from an upper surface of the base 171. The first protruding part 174 has a smaller cross-sectional area than other regions and may have a circular cross-sectional shape. The first protruding part 174 may be disposed in a bearing space 197 inside the second protruding part 196. The first protruding part 174 may be disposed to be overlapped with the first partition wall 105 in a horizontal direction.

The support 170 may be disposed to form the same center of rotation as the external gear 140. An inner surface of the support 170 may have a certain frictional force so that it can be rotated by being in contact with an outer surface of the second region 141*b*.

The pump 10 may include a bearing 180. The bearing 180 may be disposed in the bearing space 197. The bearing 180 may be a ball bearing. Accordingly, the bearing 180 may include balls being disposed between an outer ring and an inner ring. A coupling hole 182 may be formed in the center of the bearing 180. The first protruding part 174 may be coupled to the coupling hole 182. Therefore, when the support 170 rotates together with the external gear 140, the bearing 180 can support the rotation of the support 170. The support 170 may rotate integrally with the bearing 180 and the external gear 140.

According to the above structure, the internal gear is coupled with the protruding part of the first cover to align the center of axis, and since the center of axis of the external gear can be aligned through the support and bearing, it has the advantage of preventing the axial system of the external gear or internal gear from being misaligned due to pressure differences between different regions inside the housing.

In particular, when the axial system of an external gear is misaligned under high pressure conditions, the outlet pressure of the pump is formed at a maximum of 4 Bar as shown in sample A of FIG. 9, whereas the external gear according to the present embodiment can always maintains the axial system constant in a space inside the housing, as in sample B in FIG. 9, there is an advantage that the outlet pressure can be formed to be high more than twice when compared to prior art.

Furthermore, due to the stabilization of the center of rotation of the external gear by the bearing, the current can be reduced by more than 50% even during no-load operation, which has the advantage of enhancing the driving efficiency of the pump.

In the above description, it is described that all the components constituting the embodiments of the present invention are combined or operated in one, but the present invention is not necessarily limited to these embodiments. In other words, within the scope of the present invention, all of the components may be selectively operated in combination with one or more. In addition, the terms "comprise", "include" or "having" described above mean that the corresponding component may be inherent unless specifically stated otherwise, and thus it should be construed that it does not exclude other components, but further include other components instead. All terms, including technical and scientific terms, have the same meaning as commonly understood by one of ordinary skill in the art unless otherwise defined. Terms used generally, such as terms defined in a dictionary, should be interpreted to coincide with the contextual meaning of the related art, and shall not be interpreted in an ideal or excessively formal sense unless explicitly defined in the present invention.

The above description is merely illustrative of the technical idea of the present invention, and those skilled in the art to which the present invention pertains may make various modifications and changes without departing from the essential characteristics of the present invention. Therefore, the embodiments disclosed in the present invention are not intended to limit the technical idea of the present invention but to describe the present invention, and the scope of the technical idea of the present invention is not limited by these embodiments. The protection scope of the present invention should be interpreted by the following claims, and all technical ideas within the equivalent scope should be interpreted as being included in the scope of the present invention.

The invention claimed is:

1. A pump, comprising:
- a stator;
- an external gear disposed inside of the stator;
- a magnet coupled to the external gear;
- an internal gear disposed inside of the external gear;
- a can disposed inside of the stator and containing a space in which the internal gear and the external gear are disposed;
- a support partially disposed between the external gear and the magnet; and
- a bearing coupled to the support, wherein the support includes a first protruding part coupled to an inner surface of the bearing.

2. The pump according to claim 1, wherein the external gear includes a core, and wherein the support is disposed between the core and the magnet.

3. The pump according to claim 2, wherein the core includes a first region of an outer surface where a guide in contact with a side surface of the magnet is disposed, and a second region of the outer surface on which the support is disposed, and wherein a cross-sectional area of the first region is larger than a cross-sectional area of the second region.

4. The pump according to claim 3, wherein an axial length of the magnet is smaller than an axial length of the guide.

5. The pump according to claim 1, wherein the support includes:
- a base disposed on one side of the internal gear; and
- a coupling part coupled to a side of the external gear, wherein the first protruding part protrudes in a direction opposite to the coupling part.

6. The pump according to claim 1, wherein the can includes a second protruding part that protrudes upward from an upper surface of the can, and wherein the first protruding part and the bearing are disposed in a bearing space inside of the second protruding part.

7. The pump according to claim 6, wherein a cross-sectional area of the bearing corresponds to a cross-sectional area of the bearing space.

8. The pump according to claim 1, wherein the support rotates integrally with the external gear.

9. The pump according to claim 1, wherein the external gear and the internal gear are rotated eccentrically.

10. The pump according to claim 5, wherein a cross-sectional area of the base is smaller than a cross-sectional area of the external gear.

11. The pump according to claim 1, further comprising a housing in which the stator is disposed, wherein the housing includes a first space in which the internal gear and the external gear are placed, and a second space in which a printed circuit board is placed, and wherein a first partition is disposed between the first space and the second space.

12. The pump according to claim 11, wherein the first partition includes a hole into which the can is coupled.

13. The pump according to claim 12, further comprising a second protruding part that protrudes from an upper surface of the can and is coupled to the hole, wherein the bearing is disposed within the second protruding part.

14. The pump according to claim 13, wherein the housing and the can are integrally formed by insert injection.

15. The pump according to claim 3, wherein an inclined surface is formed on a side surface of the guide and the side surface of the magnet.

16. A pump, comprising:
- an external gear;
- a magnet being coupled to the external gear;
- an internal gear disposed inside of the external gear; and
- a can disposed inside of a stator and containing a space in which the internal gear and the external gear are disposed;
- a support coupled to the external gear;
- a bearing coupled to the support, wherein the support includes:
- a base disposed on a side surface of the internal gear;
- a coupling portion coupled to a side surface of the external gear; and
- a first protruding part that protrudes in a direction opposite to the coupling portion and coupled to an inner surface of the bearing.

17. The pump according to claim 16, wherein the external gear includes a core, and wherein the support is disposed between the core and the magnet.

18. The pump according to claim 17, wherein the core includes a first region of an outer surface where a guide in contact with a side surface of the magnet is disposed, and a second region of the outer surface on which the support is disposed, and wherein a cross-sectional area of the first region is larger than a cross-sectional area of the second region.

19. The pump according to claim 18, wherein an axial length of the magnet is smaller than an axial length of the guide.

20. The pump according to claim 16, wherein the external gear and the internal gear are rotated eccentrically.

* * * * *